US009106996B2

(12) United States Patent
Burgett et al.

(10) Patent No.: US 9,106,996 B2
(45) Date of Patent: Aug. 11, 2015

(54) EARPHONES

(71) Applicant: Harman International Industries, Incorporated, Stamford, CT (US)

(72) Inventors: Seth D. Burgett, Glen Carbon, IL (US); Aaron Gorga, St. Louis, MO (US); Effrosini A. Karayiannis, St. Louis, MO (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 14/214,395

(22) Filed: Mar. 14, 2014

(65) Prior Publication Data

US 2014/0270315 A1 Sep. 18, 2014

Related U.S. Application Data

(60) Provisional application No. 61/781,111, filed on Mar. 14, 2013.

(51) Int. Cl.
*H04R 1/10* (2006.01)
*H04R 5/033* (2006.01)

(52) U.S. Cl.
CPC ..... *H04R 1/105* (2013.01); *H04R 1/1066* (2013.01); *H04R 1/1016* (2013.01); *H04R 5/0335* (2013.01)

(58) Field of Classification Search
CPC ..... H04R 1/10; H04R 1/105; H04R 1/1016; H04R 1/1058; H04R 1/1066; H04R 5/033; H04R 5/0335; H04R 25/65; H04R 25/652
USPC ..... 381/322, 328, 329, 367, 370, 371, 374, 381/380; 181/129, 130, 135
See application file for complete search history.

(56) References Cited

U.S. PATENT DOCUMENTS

| | | | |
|---|---|---|---|
| 4,965,838 | A | 10/1990 | Kamon et al. |
| 6,856,690 | B1 | 2/2005 | Skulley |
| 8,111,861 | B2 | 2/2012 | Lowry |
| 2012/0027242 | A1 | 2/2012 | Son et al. |

OTHER PUBLICATIONS

International Search Report and Written Opinion for PCT/US2014/029643 Date: Aug. 11, 2014 pp. 19.

*Primary Examiner* — Curtis Kuntz
*Assistant Examiner* — Joshua A Kaufman
(74) *Attorney, Agent, or Firm* — Brooks Kushman P.C.

(57) ABSTRACT

An earphone includes a generally conical housing having generally circular front face adapted to be seated in the concha of the user's ear. The housing tapers away from the front face toward the rear of the housing. A speaker is disposed in the housing. A first resilient portion is disposed on the sidewall of the housing to form a first contact surface. A second resilient portion is disposed on the sidewall of the housing, opposite from the first resilient portion. The second resilient portion extends sufficiently circumferentially around the housing to form second and third contact surfaces disposed on opposite sides of the wire guide. The first, second, and third contact surfaces allow the housing to be grasped between the thumb and two fingers of the user to facilitate insertion of the front portion of the housing into the user's ear.

14 Claims, 4 Drawing Sheets

EARPHONES

CROSS-REFERENCE TO RELATED APPLICATIONS

This application claims priority to U.S. Provisional Patent Application Ser. No. 61/781,111, filed Mar. 14, 2013. The entire disclosure of the above-referenced application is incorporated herein.

FIELD

The present disclosure relates to earphones and in particular to in-the-ear earphones.

BACKGROUND

This section provides background information related to the present disclosure which is not necessarily prior art.

There are a wide variety of types of earphone designs, as attempts are made to improve the sound quality, comfort, security of fit, and ease of placement. However to date, most earphones are difficult to comfortably and securely place in the ear.

SUMMARY

This section provides a general summary of the disclosure, and is not a comprehensive disclosure of its full scope or all of its features.

Embodiments of the present invention provide an earphone that can be easier for the user to place in the ear and more comfortable to wear. Generally, according to a first preferred embodiment, an earphone is provided comprising a generally conical housing having a generally circular front face. This front face is adapted to be seated in the concha of the user's ear. The housing tapers away from the front face toward the rear of the housing. A speaker is disposed in the housing.

There is a first resilient portion on the sidewall of the housing, forming a first contact surface, and a second resilient portion on the sidewall of the housing, opposite from the first resilient portion. The second resilient portion extends sufficiently circumferentially around the housing to form second and third contact surfaces. The first, second, and third contact surfaces are substantially equally spaced around the circumference of the housing to permit the housing to be grasped by the resilient portions between the thumb and finger, or the thumb and two fingers of the user to facilitate insertion of the front portion of the housing into the user's ear.

The first and second resilient portions are preferably shaped so that the remaining visible portion of the housing, when viewed from the rear side, is generally Y-shaped. The first and second resilient portions are visually distinguishable from the remainder of the housing, and the first and second resilient portions are preferably visually distinguishable from each other.

In one preferred embodiment, a wire guide extends from the rear of the housing, generally transversely to the axis of the housing. The second resilient portion preferably extends sufficiently circumferentially around the housing, so that the second and third contact surfaces are disposed on opposite sides of the wire guide Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
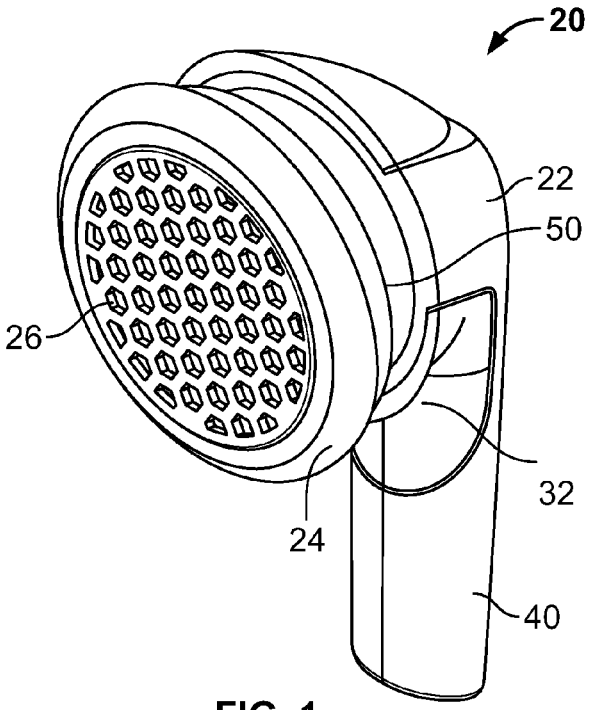
FIG. 1 is a perspective view of a preferred embodiment of an earphone, in accordance with the principles of this invention.
Figure 2:
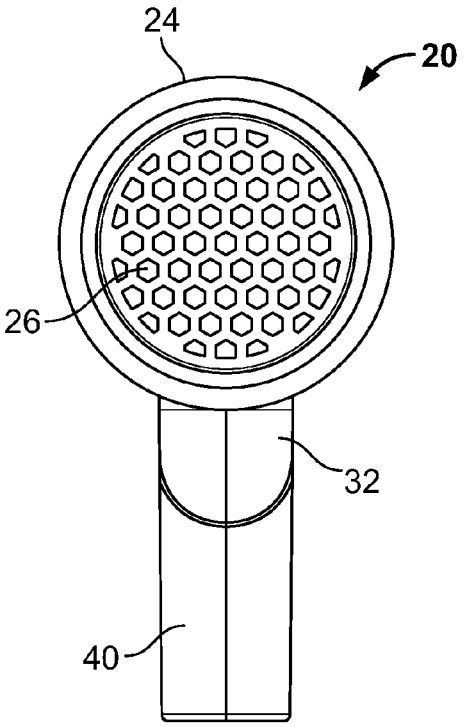
FIG. 2 is a front elevation view of the earphone.

Example embodiments will now be described more fully with reference to the accompanying drawings.

A preferred embodiment of an earphone constructed according to the principles of this invention is indicated generally as 20 in the Figures. Generally, the earphone 20 comprises a generally conical housing 22 having generally circular front face 24. The front face 24 is adapted to be seated in the concha of the user's ear. The housing 22 tapers away from the front face 24 toward the rear of the housing. A speaker (not shown) is disposed in the housing 22, behind a grill 26 at the front face.

There is preferable a first resilient portion 28 on the sidewall of the housing 22, forming a first contact surface 30. This first resilient portion 28 is generally triangularly shaped, with a rounded apex pointing toward the rear of the housing 22. The first resilient portion 28 is preferably positioned at the top of the housing 22 of the earphone 20 (as it oriented when placed in the ear). The first resilient portion 28 is preferably made of a thermoplastic elastomer, so that the first contact surface has a resilient and rubbery feel. This provides a comfortable, slip resistant griping surface (even when the earphone is wet), and provides a tactile cue to the user of where to grasp the earphone. In contrast, the rigid portions can be made of polycarbonate/acrylonitrile butadiene, styrene.

The earphone 20 preferably has a second resilient portion 32 on the sidewall of the housing 22, opposite from the first resilient portion 28. The second resilient portion 32 preferably extends sufficiently circumferentially around the housing 22 to form second and third contact surfaces 34 and 36. The first resilient portion 28 is preferably positioned at the top of the housing 22 of the earphone 20 (as the earphone is oriented when placed in the ear). The second resilient portion 32 is preferably made of thermoplastic elastomer, so that the second and third contact surfaces 34 and 36 have a resilient and rubbery feel. This provides a comfortable, slip resistant griping surface (even when the earphone is wet), and provides a tactile cue to the user of where to grasp the earphone. In contrast, the rigid portions can be made of polycarbonate/acrylonitrile butadiene, styrene.

The first, second, and third contact surfaces 30, 34, and 36 are substantially equally spaced around the circumference of the housing 22 to permit the housing to be grasped by the resilient portions between the thumb and finger, or the thumb and two fingers of the user to facilitate insertion of the front face 24 of the housing 22 into the user's ear.

Figure 3:
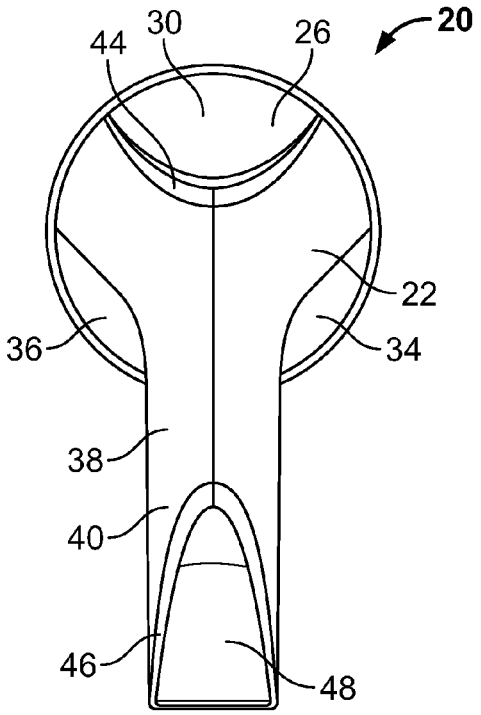
FIG. 3 is a rear elevation view of the earphone.
Figure 4:
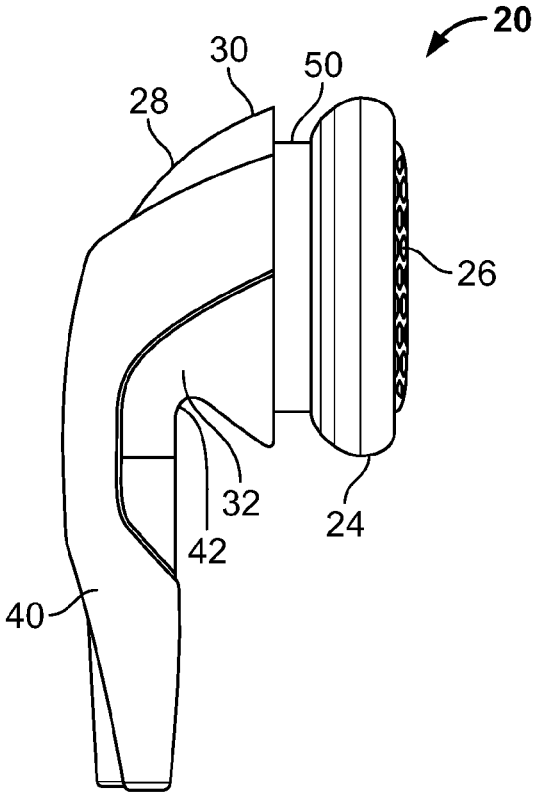
FIG. 4 is a left-side elevation view of the earphone.
Figure 5:
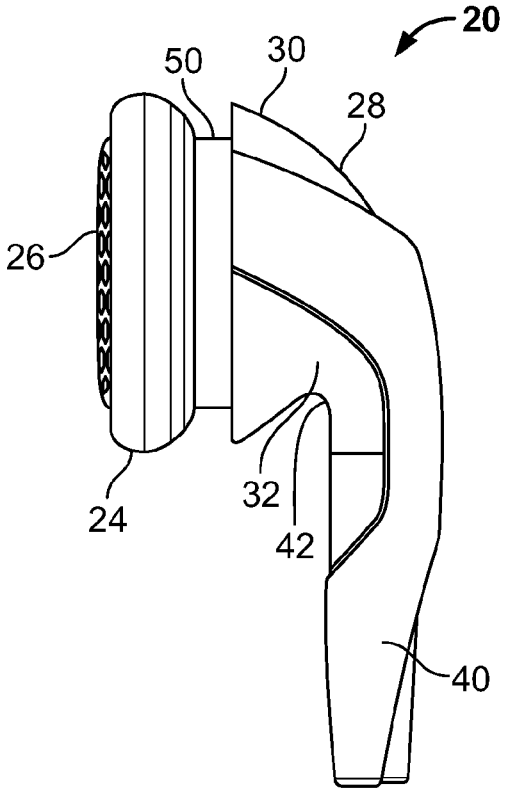
FIG. 5 is a right-side elevation view of the earphone.
Figure 6:
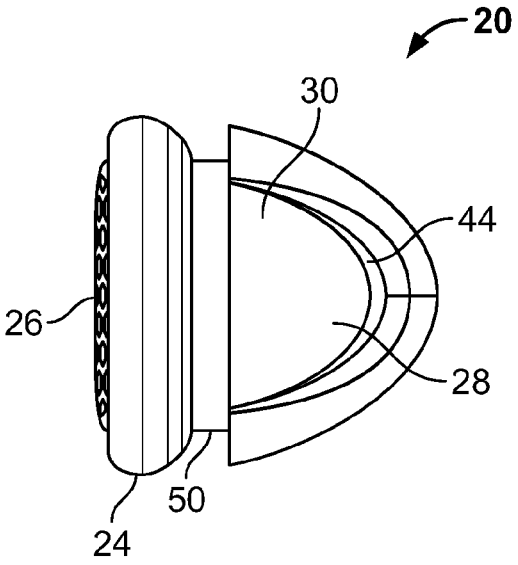
FIG. 6 is a top plan view of the earphone.
Figure 7:
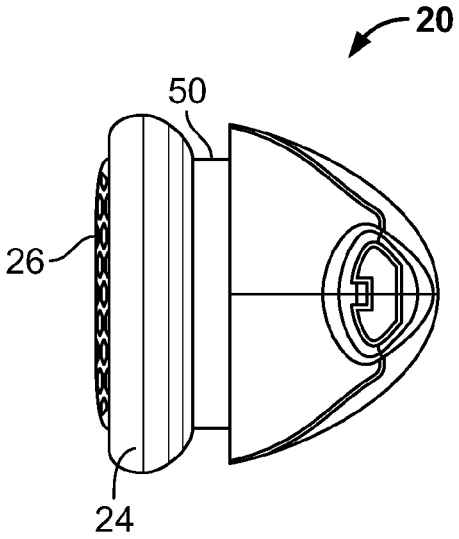
FIG. 7 is a bottom plan view of the earphone.
Figure 8:
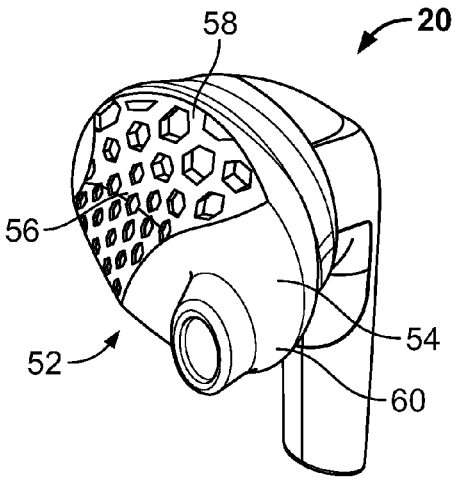
FIG. 8 is a perspective view of a preferred embodiment of an earphone, in accordance with the principles of this invention, showing an optional enhancer mounted thereon for facilitating the mechanical and sound connection with the user's ear.
Figure 9:
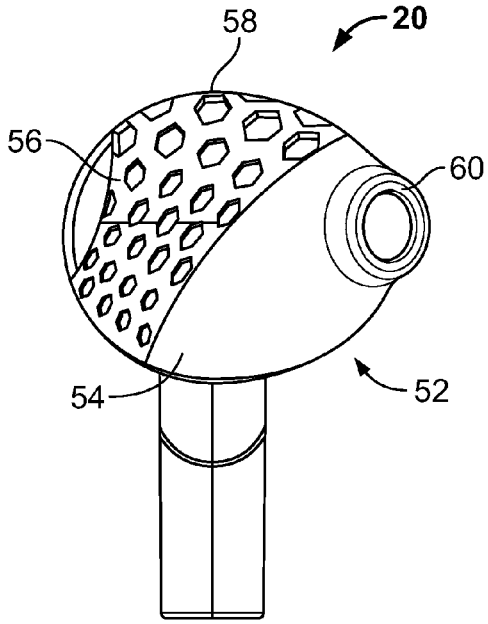
FIG. 9 is a front elevation view of the earphone and enhancer combination.
Figure 10:
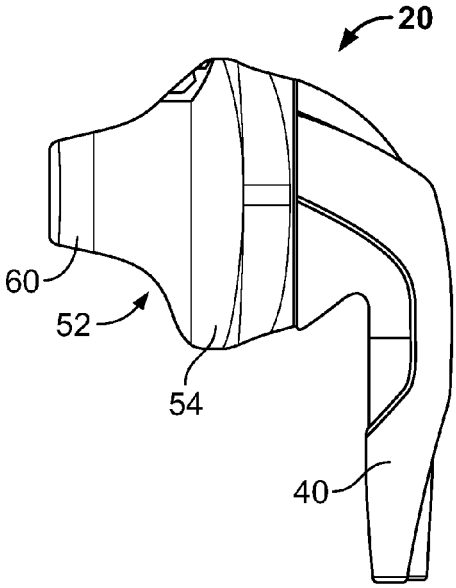
FIG. 10 is a rear elevation view of the earphone and enhancer combination.
Figure 11:
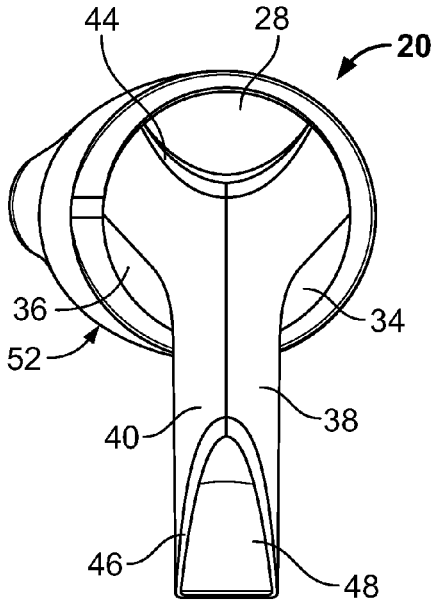
FIG. 11 is a left-side elevation view of the earphone and enhancer combination.
Figure 12:
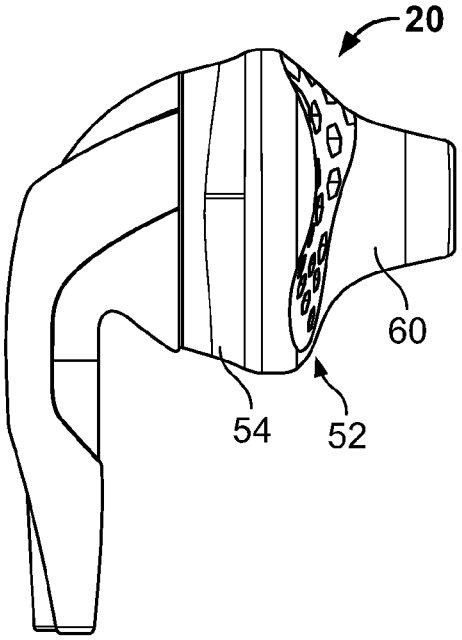
FIG. 12 is a right-side elevation view of the earphone and enhancer combination.
Figure 13:
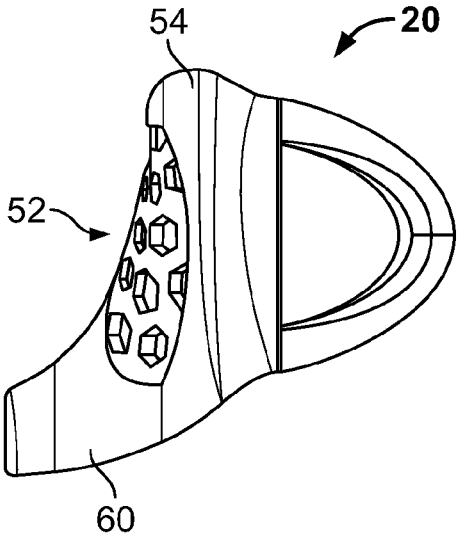
FIG. 13 is a top plan view of the earphone and enhancer combination.
Figure 14:
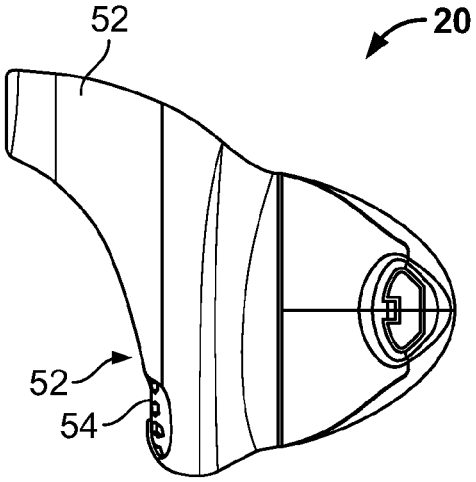
FIG. 14 is a bottom plan view of the earphone and enhancer combination.

The first and second resilient portions 28 and 32 are preferably shaped so that the remaining visible portion 38 of the housing 22, when viewed from the rear side, is generally Y-shaped, as shown in FIG. 3. The first and second resilient portions 28 and 32 are visually distinguishable from the remainder of the housing. For example, the first and second resilient portions 28 and 32 can have a matte, rubbery appearance while the remaining portion of the housing can have a polished appearance. The first and second resilient portions 28 and 32 are preferably visually distinguishable from each other. For example, the first resilient portion 28 can be grey or black, and the second resilient portion 32 can be red or some other contrasting color.

In the preferred embodiment, a wire guide 40 extends from the rear of the housing, generally transversely to the axis of the housing and downwardly (as the earphone is oriented when placed in the ear). The second resilient portion 32 preferably extends sufficiently circumferentially around the housing 22, so that the second and third contact 34 and 36 surfaces are disposed on opposite sides of the wire guide 40.

The second resilient portion 32 preferably extends over adjacent opposing surfaces of the wire guide 40, forming a generally v-shaped notch 42 that receives a portion of the user's ear when the earphone is in place in the concha of the user's ear. The resilient rubbery feel provides a comfortable, slip resistant contact with the tragus and anti-tragus, with the wire guide 40 extending between them.

A crescent-shaped relief 44 is formed between the first resilient portion 28 and the Y-shaped portion 38. A vent (not show) can be formed in the relief to enhance the sound performance of the speaker in the housing. An invented v-shaped notch 46 can be formed in the stem of the Y-shaped portion 38, revealing a portion of a sleeve 48 of resilient material inside the wire guide 40 that surrounds the wire leading to the speaker. The v-shaped notch 46 provides a stress relief so that the wire does not repeatedly bend at one point and break.

There is preferably a circumference groove 50 in the housing 22, just behind the front face 24, for mounting an interface or enhancer 52, as shown in FIGS. 8-14. The enhancer 52 engages with and acoustically connects to a user's ear, and comprises a hollow, flexible body 54 that is adapted to fit in the concha of the user's ear. The flexible body 54 has a generally oval perimeter that generally corresponds to the perimeter of the concha. The flexible body 54 further has a generally smooth, generally flat oval contact face 56 adapted to overlie the surface of the concha of the user's ear. The contact face 56 has an elongate crus relief groove 58 extending transversely across it for accommodating the crus of helix of the user's ear. The crus relief groove 58 has a pattern formed therein to make the surface more flexible, to reduce the area of contact between the enhancer 52 and the crus of helix of the user's ear. A tube 60 projects from the generally flat oval contact face 56 adjacent one end, and is adapted to extend into the user's ear canal. The tube having a generally elliptical cross-section with a circumference less than the circumference of the ear canal, so that the tube does not contact the surface of the ear canal around its entire circumference. However, a plurality of generally flexible planar, elliptical vanes project from the exterior of the tube to engage the walls of the ear canal.

In operation, a user can grasp the earphone 20 with the index finger engaging the first contact surface 30 and the thumb and middle finger engaging the second and third contact surfaces 34 and 36, and can manipulate the earphone 20 into the concha of the user's ear, until it is properly seated in the ear. Alternatively, the user can grasp the earphone 20 with the thumb and index fingers engaging the second and third contact surfaces 34 and 36, pinching the wire guide 40 therebetween, and can manipulate the earphone 20 into the concha of the user's ear, until it is properly seated in the ear. In the latter case, the first contact surface 30 is superfluous and in some embodiments can be eliminated.

The first, second, and third contact surfaces 30, 34, and 36 provide comfortable, resilient areas to grasp the earphone 20, that can remain slip resistant even when the earphones are wet. The unique feel of the contact surfaces 30, 34, and 36 provides a tactile clue of how to properly grasp and use the earphones 20.

Further areas of applicability will become apparent from the description provided herein. The description and specific examples in this summary are intended for purposes of illustration only and are not intended to limit the scope of the present disclosure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An earphone, comprising:

a generally conical housing having a generally circular front face, adapted to be seated in the concha of the user's ear, the housing tapering away from the front face toward the rear of the housing;

a speaker disposed in the housing;

a first resilient portion on the sidewall of the housing, forming a first contact surface; and a second resilient portion on the sidewall of the housing, opposite from the first resilient portion, the second resilient portion extending sufficiently circumferentially around the housing to form second and third contact surfaces, wherein the second and third contact surfaces are joined to form a v-shaped notch configured to receive a portion of the user's ear; and wherein the first, second, and third contact surfaces are substantially equally spaced around the circumference of the housing to permit the housing to be grasped by the resilient portions between the thumb and two fingers of the user to facilitate insertion of the front portion of the housing into the user's ear.

2. The earphone according to claim 1, wherein the first and second resilient portions are shaped so that the remaining visible portion of the housing, when viewed from the rear side, is generally Y-shaped.

3. The earphone according to claim 1, wherein the first and second resilient portions are visually distinguishable from the remainder of the housing.

4. The earphone according to claim 1, wherein the first and second resilient portions are visually distinguishable from each other.

5. The earphone according to claim 4, wherein the first and second resilient portions are colored differently.

6. The earphone according to claim 1, wherein the housing and the first and second resilient portions are co-molded.

7. An earphone, comprising:

a generally conical housing having generally circular front face adapted to be seated in the concha of the user's ear, the housing tapering away from the front face toward the rear of the housing, and a wire guide extending from the rear of the housing, generally transversely to the axis of the housing;

a speaker disposed in the housing;

a first resilient portion on the sidewall of the housing, opposite from the wire guide forming a first contact surface;

a second resilient portion on the sidewall of the housing, opposite from the first resilient portion, the second resilient portion extending sufficiently circumferentially around the housing to form second and third contact surfaces disposed on opposite sides of the wire guided;

wherein the second and third contact surfaces are joined to form a v-shaped notch configured to receive a portion of the user's ear; and wherein the first, second, and third contact surfaces are configured to allow the housing to be grasped between the thumb and two fingers of the user to facilitate insertion of the front portion of the housing into the user's ear.

8. The earphone according to claim 7, wherein the second resilient portion extends over adjacent opposing surfaces of the wire guide, forming a generally v-shaped notch that receives a portion of the user's ear when the earphone is seated in the concha of the user's ear.

9. The earphone according to claim 8, wherein the second resilient portion is more resilient than the first resilient portion.

10. The earphone according to claim 7, wherein the first and second resilient portions are shaped so that the remaining visible portion of the housing, when viewed from the rear side, is generally Y-shaped.

11. The earphone according to claim 7, wherein the first and second resilient portions are visually distinguishable from the remainder of the housing.

12. The earphone according to claim 7, wherein the first and second resilient portions are visually distinguishable from each other.

13. The earphone according to claim 12, wherein the first and second resilient portions are colored differently.

14. The earphone according to claim 7, wherein the housing and the first and second resilient portions are co-molded.

* * * * *